US007097062B2

(12) United States Patent
DeRosa

(10) Patent No.: US 7,097,062 B2
(45) Date of Patent: Aug. 29, 2006

(54) LAUNDRY BASKET

(76) Inventor: David J. DeRosa, 365 Brewster St. Apt. C, Bridgeport, CT (US) 06605

( * ) Notice: Subject to any disclaimer, the term of this patent is extended or adjusted under 35 U.S.C. 154(b) by 290 days.

(21) Appl. No.: 10/621,914

(22) Filed: Jul. 17, 2003

(65) Prior Publication Data

US 2005/0011900 A1 Jan. 20, 2005

(51) Int. Cl.
*B65D 21/02* (2006.01)

(52) U.S. Cl. ..... 220/23.86

(58) Field of Classification Search ..... None
See application file for complete search history.

(56) References Cited

U.S. PATENT DOCUMENTS 4,950,083 A * 8/1990 Bavaveas ..... 366/348

5,964,372 A * 10/1999 Dubois et al. ..... 220/642

* cited by examiner

*Primary Examiner*—Stephen Castellano
(74) *Attorney, Agent, or Firm*—Grimes & Battersby, LLP

(57) ABSTRACT

A laundry basket is provided of the type having a bottom wall, a pair of opposed side walls and a pair of opposed end walls all extending upwardly from the bottom wall. The basket includes at least one receptacle formed into at least one of the side walls for receiving and retaining a clear plastic, refillable laundry product tube adapted to store a laundry product such as soap, bleach or fabric softener. The laundry basket further includes at least one handle formed into at least one of the end walls including a center aperture for receiving and retaining a coin tube adapted to store coins for use in a washing machine or drier. In an alternative embodiment, the laundry product tube may be stored in the center aperture of said handles.

8 Claims, 2 Drawing Sheets

LAUNDRY BASKET

FIELD OF THE INVENTION

The present invention relates generally to a laundry basket and, more particularly, to a "Laundromat friendly" laundry basket that includes receptacles for such laundry related products as soap, bleach fabric softeners, etc., to facilitate their storage and transportation.

For apartment and condo dwellers, the trip to the Laundromat can be a juggling act of dirty laundry; laundry baskets; and boxes of soap, bleach and fabric softeners plus a pocketful of quarters to operate the applicable washers and dryers. All of these essential elements are typically put into a laundry basket or two and carried into the Laundromat by the customer. Since the standard size boxes of soap, bleach and fabric softener are targeted for home use, transportation of these boxes along with the laundry and baskets can be a Herculean task.

DESCRIPTION OF THE PRIOR ART

Consumers have been using traditional plastic molded laundry baskets since time in memoriam. These baskets come in all sizes and shapes according to personal preference. See, for example, U.S. Design Pat. No. D348,128 which issued on Jun. 21, 1994 to Charles W. Kraft et al. for a rectangular Laundry Basket or U.S. Design Pat. No. D416,116 which issued on Nov. 2, 1999 to Janet Sofy for a bean shaped Laundry Basket or U.S. Design Pat. No. D356,194 which issued on Mar. 7, 1995 to Joseph Messina for a round Laundry Basket with a cover. Some come with wheels, e.g., U.S. Design Pat. No. D440,020 which issued on Apr. 3, 2001 to Terin B. Ronson et al. for Laundry Basket on Wheels; or dividers, e.g., U.S. Design Pat. No. 433,548 which issued on Nov. 7, 2000 to Ronald Baines et al. for Laundry Basket with Dividers; or even special handles, e.g., U.S. Pat. No. 5,133,472 which issued on Jul. 28, 1992 to Walter P. Koda et al. for Laundry Basket and Handle Therefore.

The general idea of providing a laundry basket with receptacles or compartments for different types of clothing or to accommodate laundry products is not new. Consider, for example, U.S. Pat. No. 4,981,232 which issued on Jan. 1, 1991 to Paul W. Wynn for a Laundry Basket that includes a clothes washing products compartment as part of the basket in addition to a section for clothing. Since these compartments are both contained in the context of a standard laundry basket, it offers reduced space for the clothing as well as marginally sufficient space for boxes of laundry products.

As will be appreciated, none of these prior patents even address the problem faced by applicant let alone offer the solution proposed herein.

SUMMARY OF THE INVENTION

Against the foregoing background, it is a primary object of the present invention to provide a molded laundry basket that includes a full sized cavity for clothing.

It is another object of the present invention to provide such a laundry basket that further includes provisions for such laundry products as soap, bleach, and fabric softeners.

It is still another object of the present invention to provide such a laundry basket that further includes refillable individual tubes for such laundry products.

It is still yet another object of the present invention to provide such a laundry basket in which such refillable tubes are releasably secured in receptacles on the outside of said baskets so as not to unduly limit the storage size of the basket for clothing.

To the accomplishments of the foregoing objects and advantages, the present invention, in brief summary, comprises a laundry basket of the type having a bottom wall and pairs of opposed side walls and end walls all extending upwardly from the bottom wall. The basket includes at least one receptacle formed into at least one of the side walls or end walls for receiving and retaining at least one clear plastic, refillable laundry product tube adapted to store a laundry product such as soap, bleach or fabric softener. In one embodiment, a pair of receptacles are provided on opposed side walls while in an alternative embodiment, the receptacles are formed by the handles on the end walls.

BRIEF DESCRIPTION OF THE DRAWINGS

The foregoing and still other objects and advantages of the present invention will be more apparent from the detailed explanation of the preferred embodiments of the invention in connection with the accompanying drawings, wherein.

DESCRIPTION OF THE PREFERRED EMBODIMENTS

Figure 1:
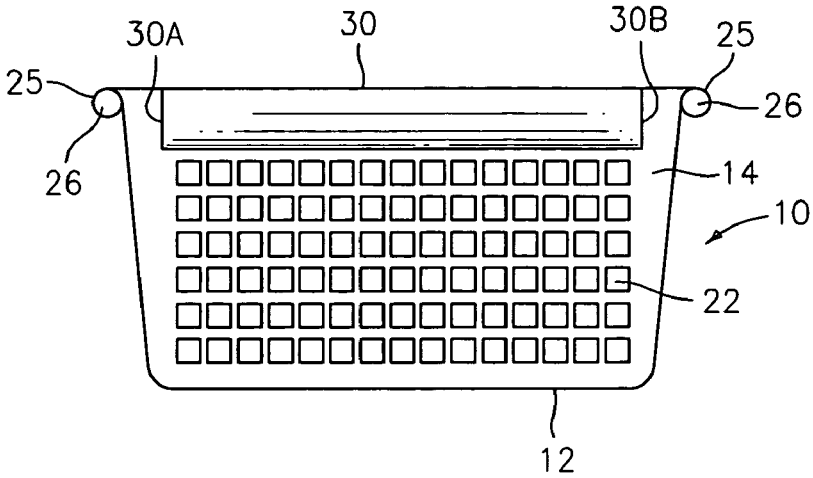
FIG. 1 is a side view of the laundry basket of the present invention.
Figure 2:
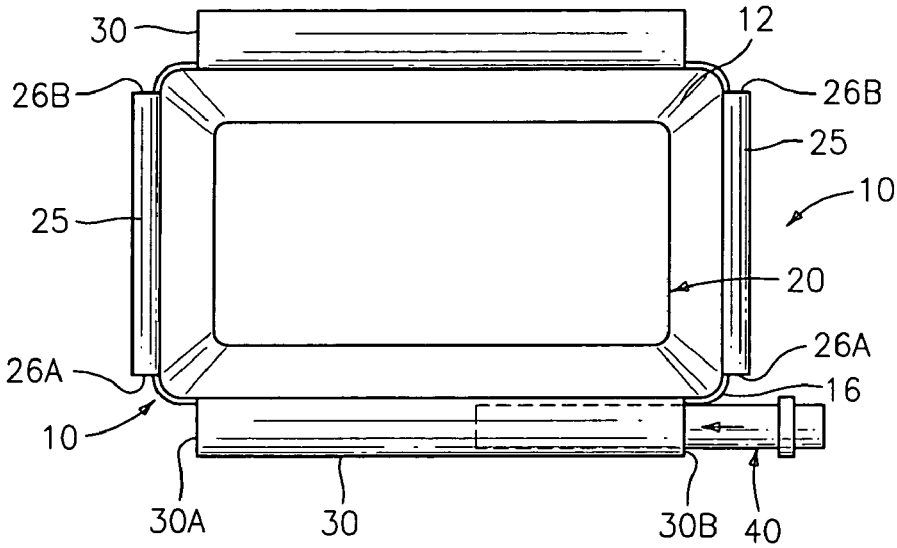
FIG. 2 is a top view of the laundry basket of the present invention.
Figure 3:
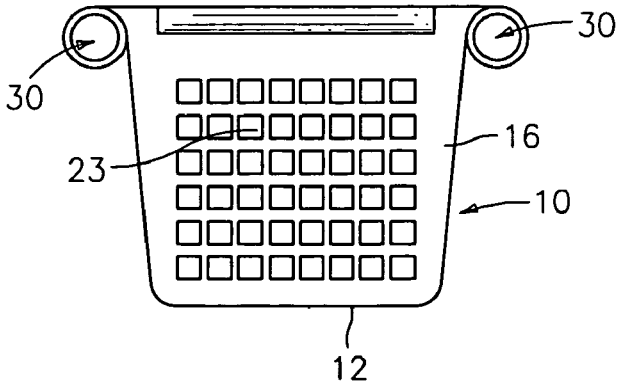
FIG. 3 is an end view of the laundry basket of the present invention.

Referring to the drawings and, in particular, to FIGS. 1–3 thereof, the laundry basket of the present invention, referred to generally by reference numeral 10, is of the typical plastic molded type having a bottom wall 12 and pairs of opposed side walls 14 and end walls 16 extending upwardly from the bottom wall 12 defining an open top 20. The bottom wall 12 and the side walls 14 and end walls 16 may include a multiplicity of apertures or openings 22 spaced throughout the wall to facilitate air flow into and out of the basket 10. Hollow handles 25 are provided at the upper end of the opposed end walls 14 to facilitate gripping of the laundry basket 10 by a user, each of which includes a center aperture 26 with open ends 26A and 26B at the opposite ends thereof.

The laundry basket 10 of the present invention includes a pair of opposed, cylindrically shaped receptacles 30 at the top of the side walls 14 which are open at their opposite ends 30A and 30B. Receptacles 30 are adapted to receive and retain one or more refillable tubes 40 which can be inserted into the receptacle through either end 30A or 30B.

Figure 4:
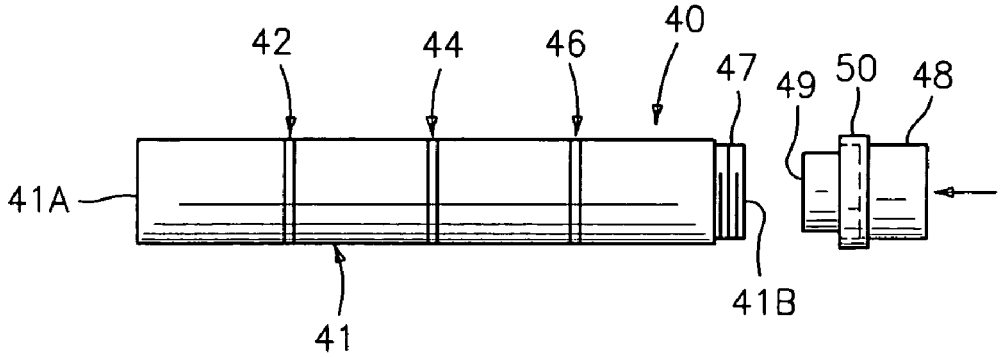
FIG. 4 is an exploded side view of the refillable tubes used for the storage of laundry products that can be used in conjunction with the laundry basket of the present invention.

Refillable tube 40, which is shown in greater detail in FIG. 4, is a tube have a body 41 which is adapted to receive a laundry product such as, for example, soap, bleach or fabric softeners. In a preferred embodiment, tube 40 is a clear plastic or glass tube to permit the user to see the contents contained therein. Tube 40 is closed at one end 41A and open at its opposed end 41B. Threads 47 are provided on the body 41 of the tube 40 adjacent open end 41B. Measuring marks 42, 44 and 46 are provided as stripes around the clear tube to indicate appropriate measurements of the laundry products contained in the tube which is introduced through the open end 41A so as to facilitate dispensing of the contents in the washing machine. A cap 48 is provided with internal threads at an end 49 adapted to threadably engage threads 47 at the open end 41B of the tube 40 in order to seal same. A stop ring 50 is provided about the outer diameter of cap 48. Stop ring 50 has a larger diameter than the diameter of either the cap 48 or the receptacle 30 and serves to limit the penetration of the refillable tube 40 when inserted into the receptacle 30.

The advantage offered by the use of a refillable laundry product tube 40 is that the user can simply bring with them the amount of laundry product that is necessary for the particular trip to the Laundromat. Since the laundry product tubes 40 are refillable, they can be refilled for each trip and, as such, will not take up unnecessary room in the basket as would be the case with large boxes of soap, bleach and the like. As the use of these types of laundry baskets becomes more popular, it is conceivable that producers of such laundry products might begin to market their products in individual tubes rather than in the otherwise large, cumbersome boxes heretofore used so that users can simply purchase pre-filled tubes of such laundry products to be used in conjunction with the laundry basket of the present invention.

Figure 5:
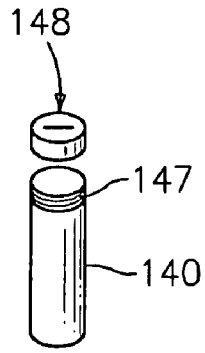
FIG. 5 is a perspective view of an alternative refillable tube used for storage of coins.

FIG. 5 illustrates a refillable coin tube 140 for storing the types of coins that are used in most Laundromats, e.g., quarters, etc. Coin tube 140 includes a threaded end 147 adapted to engage a cap 148 used to close and seal the coin tube 140. The diameter of coin tube 140 is such that it can be inserted into and retained in the aperture 26 of the handle 25. Coin tube 140 may also be inserted into receptacle 30, if so desired.

Figure 6:
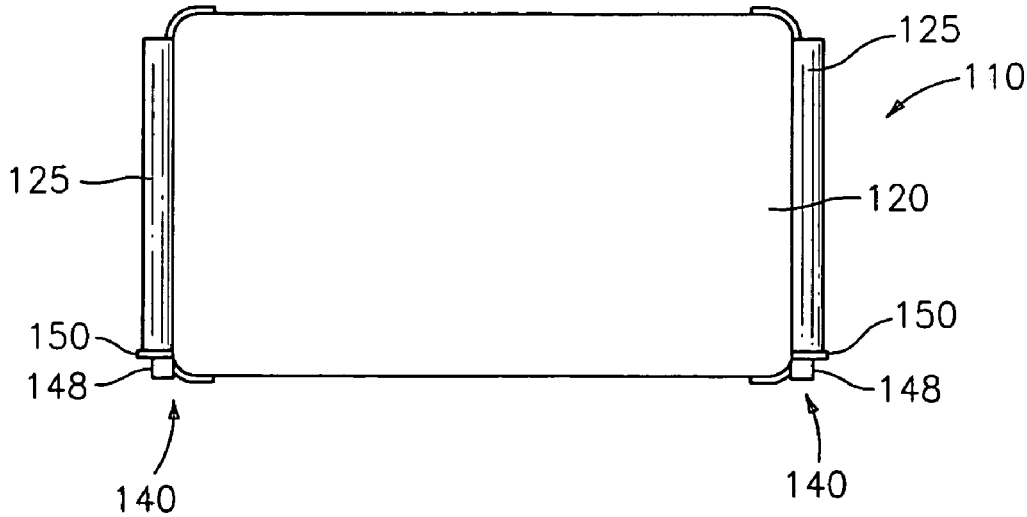
FIG. 6 is a top view of an alternative embodiment of the basket of the present invention in which the refillable tubes used for the storage of laundry products are adapted to be inserted into apertures created as part of the handles of the basket.

FIG. 6 depicts an alternative embodiment of the laundry basket 110 of the present invention having an open top 120. The basket 110 includes a pair of handles 125 at opposed ends of the basket 110 with receptacle formed as part of the handles into which laundry product tubes 140 may be inserted and stored in much the same manner as they are stored in receptacles 30 of the basket 10 of the embodiment of FIGS. 1–3. In the embodiment of FIG. 6, both handle 125 include such receptacles for storage of the tubes 140. No receptacles are provided on the side walls of the basket 110.

It will appreciated that the trip to the Laundromat for the user of the present laundry basket will be substantially easier than with existing products since all of the laundry products and the necessary coinage are contained in tubes that are retained in discrete areas of the laundry basket 10.

Having thus described the invention with particular reference to the preferred forms thereof, it will be obvious that various changes and modifications can be made therein without departing from the spirit and scope of the present invention as defined by the appended claims.

I claim:

1. A portable laundry system, said system including:

a laundry basket of the type having a bottom, a pair of opposed side walls and a pair of opposed end walls each extending upwardly from said bottom, wherein at least two of said walls include a handle formed at the top thereof with a tubular receptacle formed therein; and at least one, tubular shaped, laundry product container for storing a laundry product, said laundry product container inserted into and retained within at least one of said tubular receptacles formed in the handles of said laundry basket.

2. The portable laundry system of claim 1, wherein said laundry product container is a clear plastic laundry product tube that is closed at one end, open at its opposite end, and includes internal threads adjacent said open end to threadably engage a cap to seal said laundry product tube.

3. The portable laundry system of claim 2, wherein said laundry product container further includes an end cap having external threads for threadably engaging the internal threads on said laundry product tube, wherein said end cap includes a stop ring for limiting the extent to which said laundry product container can be inserted into one of said tubular receptacles.

4. The portable laundry system of claim 1, wherein said laundry product is selected from the group consisting of soap, bleach and fabric softener.

5. The portable laundry system of claim 1, further including at least one, tubular shaped, coin container for storing coins for use in operating a laundry machine, said coin container adapted to be inserted into and retained with at least one of said tubular receptacles formed in the handles of said laundry basket.

6. The portable laundry system of claim 5, wherein said coin container comprises a clear plastic, coin tube that is closed at one end, open at its opposite end, and includes internal threads adjacent said open end to threadably engage a cap to secure said coins within said coin tube, and further including an end cap having external threads for threadably engaging the internal threads on said coin tube, wherein said end cap includes a stop ring for limiting the extent to which said coin container can be inserted into one of said tubular receptacles.

7. A portable laundry system, said system including:

a laundry basket of the type having a bottom, a pair of opposed side walls and a pair of opposed end walls each extending upwardly from said bottom, wherein at least two of said walls include a handle formed at the top thereof with a tubular receptacle formed therein;

at least one, tubular shaped, laundry product container for storing a laundry product comprising a clear plastic laundry product tube that is closed at one end, open at its opposite end, and includes internal threads adjacent said open end to threadably engage a cap to seal said laundry product tube, said laundry product container inserted into and retained within at least one of said tubular receptacles formed in the handles of said laundry basket; and at least one, tubular shaped, coin container for storing coins for use in operating a laundry comprising a clear coin tube that is closed at one end, open at its opposite end, and includes internal threads adjacent said open end to threadably engage a cap to seal said coin tube, said coin container inserted into and retained within at least one of said tubular receptacles formed in the handles of said laundry basket.

8. A portable laundry system, said system including:

a laundry basket of the type having a bottom, a pair of opposed side walls and a pair of opposed end walls each extending upwardly from said bottom, wherein at least two of said walls include a handle formed at the top thereof with a tubular receptacle formed therein;

at least one, tubular shaped, laundry product container for storing a laundry product selected from the group consisting of laundry detergent, bleach and fabric softener, said laundry product container inserted into and secured within at least one of said tubular receptacles formed in one of the handles of the laundry basket, wherein said laundry product container comprises a clear plastic laundry product tube that is closed at one end, open at its opposite end, and includes internal threads adjacent said open end and includes an end cap having external threads for threadably engaging the internal threads on said laundry product tube so as to seal same and a stop ring for limiting the extent to which said laundry product container can be inserted into one of said tubular receptacles; and at least one, tubular shaped, coin container for storing coins for use in operating a washer or a dryer, said coin container inserted into and secured within at least one of said tubular receptacles formed in one of the handles of the laundry basket, wherein said coin container comprises a clear plastic, coin tube that is closed at one end, open at its opposite end, and includes internal threads adjacent said open end and includes an end cap having external threads for threadably engaging the internal threads on said coin tube so as to seal same and a stop ring for limiting the extent to which said coin container can be inserted into one of said tubular receptacles.

* * * * *